US007155950B2

(12) United States Patent
Dommel et al.

(10) Patent No.: US 7,155,950 B2
(45) Date of Patent: Jan. 2, 2007

(54) DAMPERS FOR FURNACE COILERS

(75) Inventors: Werner Dommel, Hilchenbach (DE); Wolfgang Fuchs, Hilchenbach (DE); Andreas Bohn, Hilchenbach (DE)

(73) Assignee: SMS Demag AG, Düsseldorf (DE)

( * ) Notice: Subject to any disclaimer, the term of this patent is extended or adjusted under 35 U.S.C. 154(b) by 70 days.

(21) Appl. No.: 10/496,052

(22) PCT Filed: Nov. 20, 2002

(86) PCT No.: PCT/EP02/12973

§ 371 (c)(1),
(2), (4) Date: May 19, 2004

(87) PCT Pub. No.: WO03/048397

PCT Pub. Date: Jun. 12, 2003

(65) Prior Publication Data

US 2004/0261484 A1 Dec. 30, 2004

(30) Foreign Application Priority Data

Dec. 5, 2001 (DE) ..... 101 59 717

(51) Int. Cl.
*B21C 47/00* (2006.01)
*B21B 27/06* (2006.01)

(52) U.S. Cl. ..... 72/148; 72/202

(58) Field of Classification Search ..... 72/200, 72/229, 231, 146, 128, 148, 202; 242/590, 242/596.3, 596.8
See application file for complete search history.

(56) References Cited

U.S. PATENT DOCUMENTS 4,761,983 A * 8/1988 Ginzburg et al. ..... 72/148
5,009,092 A * 4/1991 Buchegger ..... 72/148
5,269,166 A 12/1993 Thomas
5,848,543 A * 12/1998 White ..... 72/202
6,089,067 A * 7/2000 Yoshioka et al. ..... 72/148

FOREIGN PATENT DOCUMENTS

| | | | |
|---|---|---|---|
| DE | 904547 | | 5/1950 |
| DE | 3000638 A | * | 7/1980 |
| DE | 3224621 | | 3/1983 |
| DE | 4016256 | | 12/1990 |
| EP | 0936276 | | 8/1999 |

* cited by examiner

*Primary Examiner*—Dmitry Suhol
(74) *Attorney, Agent, or Firm*—Friedrich Kueffner

(57) ABSTRACT

The invention relates to a damper construction (2) of a furnace coiler (1) which can especially be used in Steckel mills (1). A hot rolled strip is respectively coiled onto, and uncoiled off, a drum inside the furnace in a reversing manner, by means of a back and forth transport movement, and is optionally heated. Guiding flaps (6, 6') are mounted on the displaceable damper (2) of the furnace coiler, for inserting and guiding the rolled strip. In order to improve maintenance work, the dampers (2) and the furnace coiler (1) are embodied as separate components. The dampers (2) are arranged on an element (4') pertaining to a displaceable roller rack (4), said element being located beneath the furnace coiler (1). Each damper (2) is divided into at least two elements (2', 2") which can be hinged together, the two hinged elements being connected by means of a hinge bearing (7) in a pivoting manner.

7 Claims, 4 Drawing Sheets

1
12
13
13
7'
8'
6
4'
2
2'
2''
7
3
8
9
14
14
X
X

DAMPERS FOR FURNACE COILERS

The invention pertains to furnace doors for coiler furnaces, suitable especially for use in Steckel rolling mills, where, as the hot-rolled strip is being transported back and forth in a reversing manner through the mill, it is coiled onto a drum in one of these furnaces and uncoiled from another drum in the other furnace and possibly heated, the door being equipped with guide tables, which are mounted on the movable furnace door to feed in and guide the strip, where the furnace doors and the coiler furnace are separate components, each furnace door being divided into at least two elements, which can be folded toward and away from each other, and where the two door elements are connected by a door support so that they have the freedom to pivot.

Because of the extremely high thermal loads imposed by the Steckel furnaces, their adjustable doors have been equipped with pneumatically actuated drives. The conventional practice has been to attach these doors directly to the furnace. DE 40 16 256 A1 discloses a Steckel furnace of this type. In this case, however, it is difficult to replace the guide tables, which are mounted on the doors. Before the tables can be replaced, the furnace must be cooled down completely. This requires a difficult and time-consuming work process, however, not only because of the very long cooling times but also because of the extremely difficult working conditions. These circumstances result in high labor costs and force the system in question to be idle for long periods of time. DE 40 16 256 A1, however, also discloses a Steckel furnace of the general type in question, but it suffers from the same disadvantages.

In view of recognized difficulties, a proposal was developed as a remedy in EP 0 936 276 A2 to improve the coiler furnaces used especially in Steckel rolling mills.

The coiler furnace known from the previously mentioned document comprises an upper housing part and a lower housing part, which can be tightly connected to each other, and a furnace drum in the housing with means for accepting a rolled strip. The housing also has a bottom part, separate from the lower housing; this bottom part of the housing is able to move relative to the lower housing. As a result, the bottom part can be moved even when the interior of the furnace is still hot. The bottom part is designed and mounted in such a way that it can be moved or removed together with the movable roller table rolls. As a result, the replacement time is reduced from the previous 30 hours to approximately 5 hours.

Proceeding from the state of the art indicated above, the invention is based on the task of providing an improved design for a coiler furnace and especially for its door, by means of which even shorter replacement times can be achieved.

This task is accomplished for furnace doors of the type indicated in the introductory clause of Claim 1 in that the furnace doors and the associated coiler furnace are separate components; in that the furnace doors are mounted on a part of a roller table frame located underneath the coiler furnace; and in that each furnace door is divided into at least two elements, which can be folded toward and away from each other, the two door elements being connected to each other by a door support so that they have the freedom to pivot.

In an embodiment of the invention, it is provided that the roller table frame is able move along guide rails and thus carry the furnace door out of the thermal radiation zone of the coiler furnace.

Attaching the furnace doors to the movable roller table located underneath the furnace offers the great advantage that the furnace doors can be moved out of the thermal radiation zone of the furnace for the purpose of maintenance. The furnace tables and the doors can thus be easily maintained. The use of hydraulic cylinders can also make it easier to operate the doors and the elements which move them.

An embodiment of the device according to the invention also provides that the support for the door is mounted on the roller table frame by way of at least one bracket on the drive side and at least one bracket on the operating side.

So that the doors can be supported in exactly the right position under the furnace, the movable part of the roller table frame is pushed onto adjustable support pads during the reinstallation process. The exact positioning in the rolling direction can be achieved by adjusting the frame on the support pads.

To absorb the forces which develop during the movement of the strip, the roller table frame is locked in place according to the invention by locking cylinders.

Additional embodiments provide that at least one hydraulic cylinder is assigned to each of the pivoting elements of the furnace door, these cylinders preferably being installed on the operating side.

And finally, the design of the furnace door according to the invention is characterized in that it is mounted on the brackets in such a way that its height can be adjusted.

Additional details, features, and advantages of the invention can be derived from the following explanation of an exemplary embodiment, which is illustrated schematically in the drawings.

Figure 1:
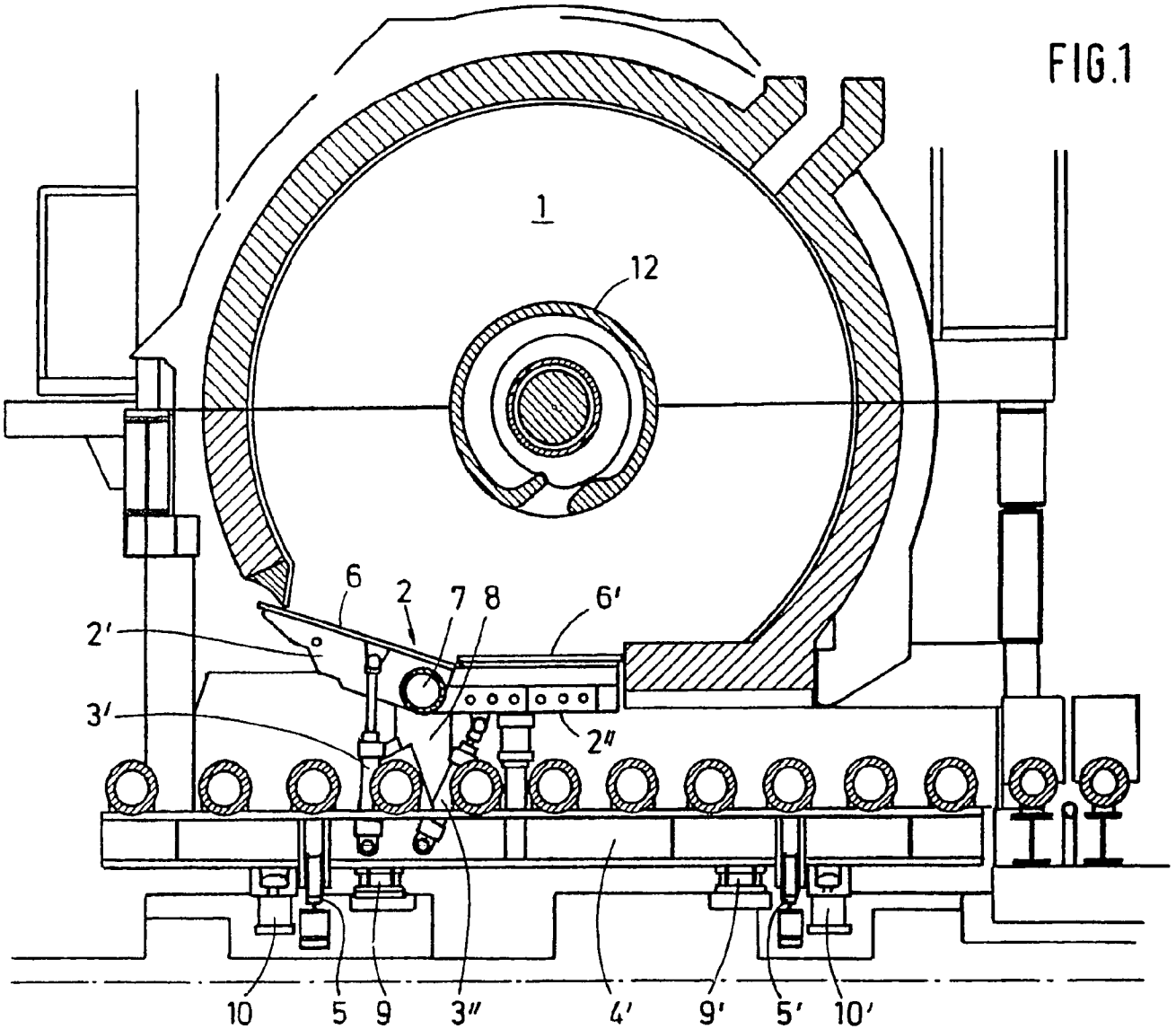
FIG. 1 shows a cross section of a coiler furnace along a plane x—x in FIG. 4, the furnace being installed above a roller table, the door being completely closed to allow the rolled strip to pass freely.
Figure 2:
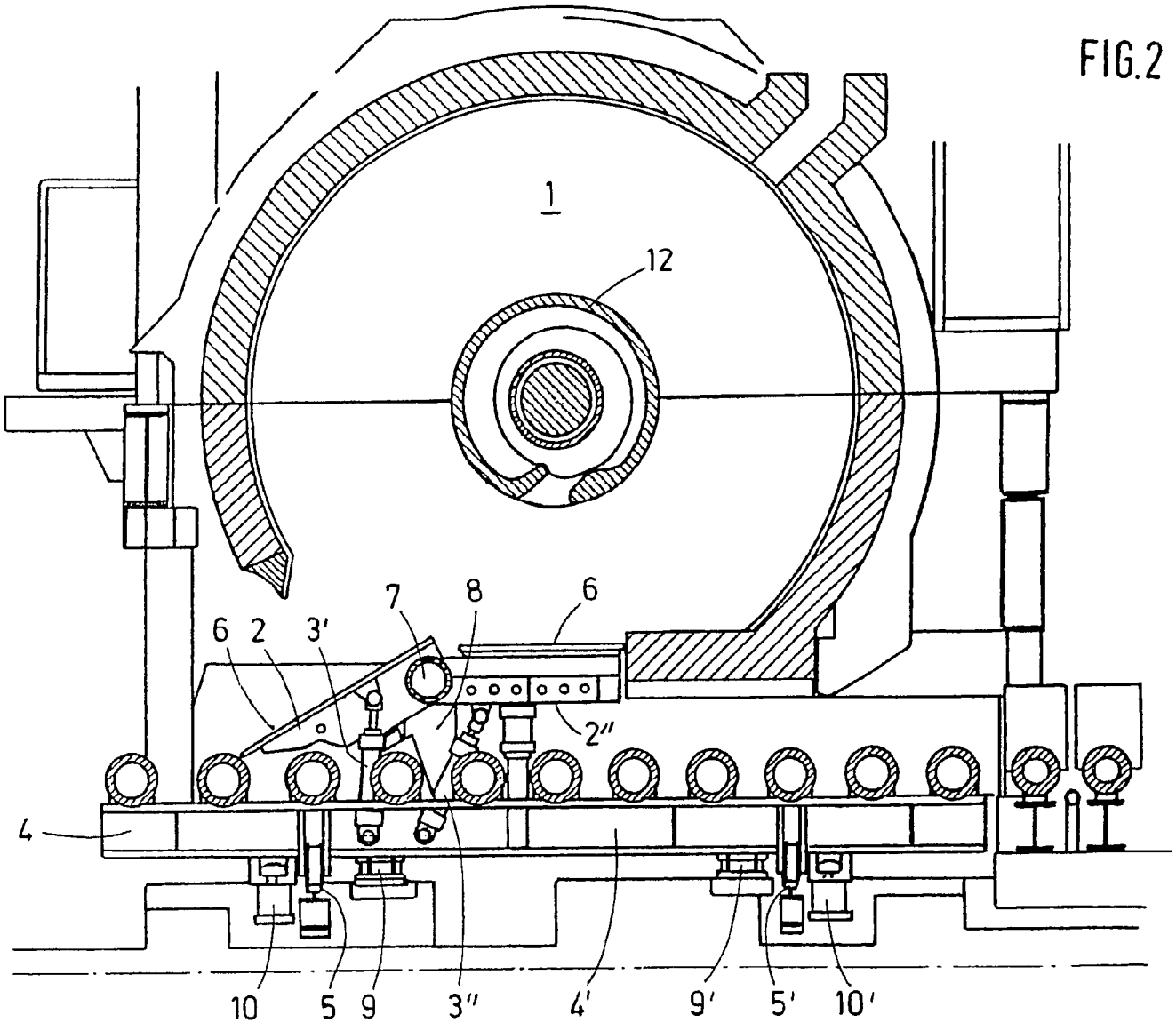
FIG. 2 shows the coiler furnace according to FIG. 1, but with a partially opened door, the forward part of the door having been lowered to form an angle with the roller table.
Figure 4:
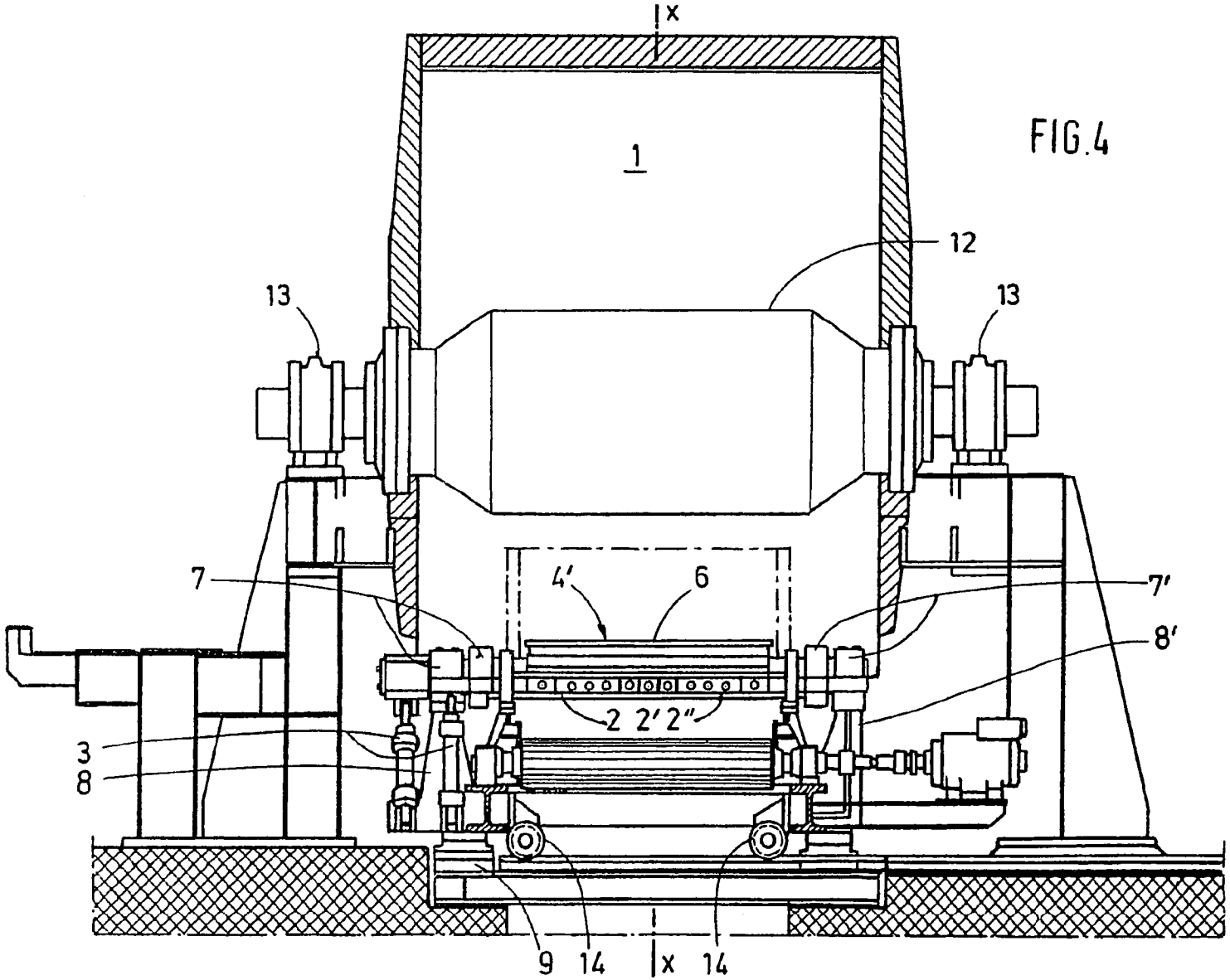
FIG. 4 shows a cross section of the rollertable frame along a plane perpendicular to the direction of travel, with the coiler furnace behind it.

FIG. 1 shows a longitudinal cross section of a coiler furnace 1, which can be used especially in Steckel rolling mills, along the plane x—x in FIG. 4. A rolled strip 11 is uncoiled from a furnace drum 12 in one of these furnaces and coiled onto another drum in the other furnace in a reversing manner as it passes back and forth through the rolling stand situated between them. The coiler furnace holds the rolled strip at rolling temperature or heats it to the proper temperature. Guide tables 6, 6' for feeding in and/or guiding the rolled strip 11 are mounted on separately movable parts 2', 2" of the furnace doors.

The furnace door 2, i.e., the door parts 2', 2", according to the invention and the associated coiler furnace 1 are separate components. These are mounted on a part 4' of the roller table frame 4 located underneath the coiler furnace 1. The furnace door can be divided into at least two elements 2', 2", which can be folded back and forth relative to each other, and which are for this purpose connected to each other by a door support, which is designed as a hinge 7, permanently connected to the part 4' of the roller table frame 4. As a result, it is possible to create an opening in the lower part of the housing of the coiler furnace 1, an opening which greatly improves the accessibility of the interior of the furnace for the sake of, for example, repair work or inspection.

In the position of the furnace door 2 according to FIG. 1, a finish-rolled hot strip is being removed from the system, bypassing the coiler furnace and its lower opening. The forward door part 2' has been raised by the hydraulic cylinder 3' to form a certain angle, whereas the rear door part 2" remains in the horizontal position. The two door parts 2', 2" are connected to each other and jointly supported around an axis of rotation by the door support 7. The hydraulic cylinder 3" is assigned to the rear door part 2", so that this part can also be pivoted. The door support 7 is itself mounted on the roller table frame part 4' by at least one bracket 8, 8' on the drive side and at least one on the operating side (the operating side is on the left of the plane x—x in FIG. 4).

The part 4' of the roller table frame 4 has rollers 14 by which it can travel out sideways from the roller table frame 4 along rails 5, 5' under the action of one or more hydraulic cylinders and thus out of the thermal radiation zone of the coiler furnace 1, as can be seen in FIG. 4. The number 6 designates the guide tables resting on top. FIGS. 1–4 also show the motorized furnace drum 12 mounted in the interior of the coiler furnace 1 and its reel bearings 13, 13'.

The door support 7, the brackets 8 for the door support 7, and the hydraulic cylinders 3 for the pivoting movement of the door parts 2, 2' can also be seen in FIG. 4. The reference numbers 9, 9' designate the support pads by which the roller table part 4' rests on the furnace foundation. The roller table itself is equipped on its drive and operating sides with the brackets 8, 8', which serve to accept the door support 7. The hydraulic cylinders 3, that is, the cylinders 3' and 3", are assigned in that order to the furnace door, i.e., to its parts 2', 2", as can be seen by way of example in FIG. 3. The hydraulic cylinders 3', 3" are also attached to the roller table frame part 4' and can be moved sideways together with it away from the roller table 4 and brought into a maintenance position. To ensure that the laterally movable elements can be returned to the exact position required underneath the coiler furnace 1, the roller table frame part 4' is pushed onto the adjustable support pads 9.

As soon as the roller table frame part has been positioned exactly on the support pads 9, 9' in the rolling direction, the roller table frame part 4' is locked in place by the locking cylinders 10, 10'.

Figure 3:
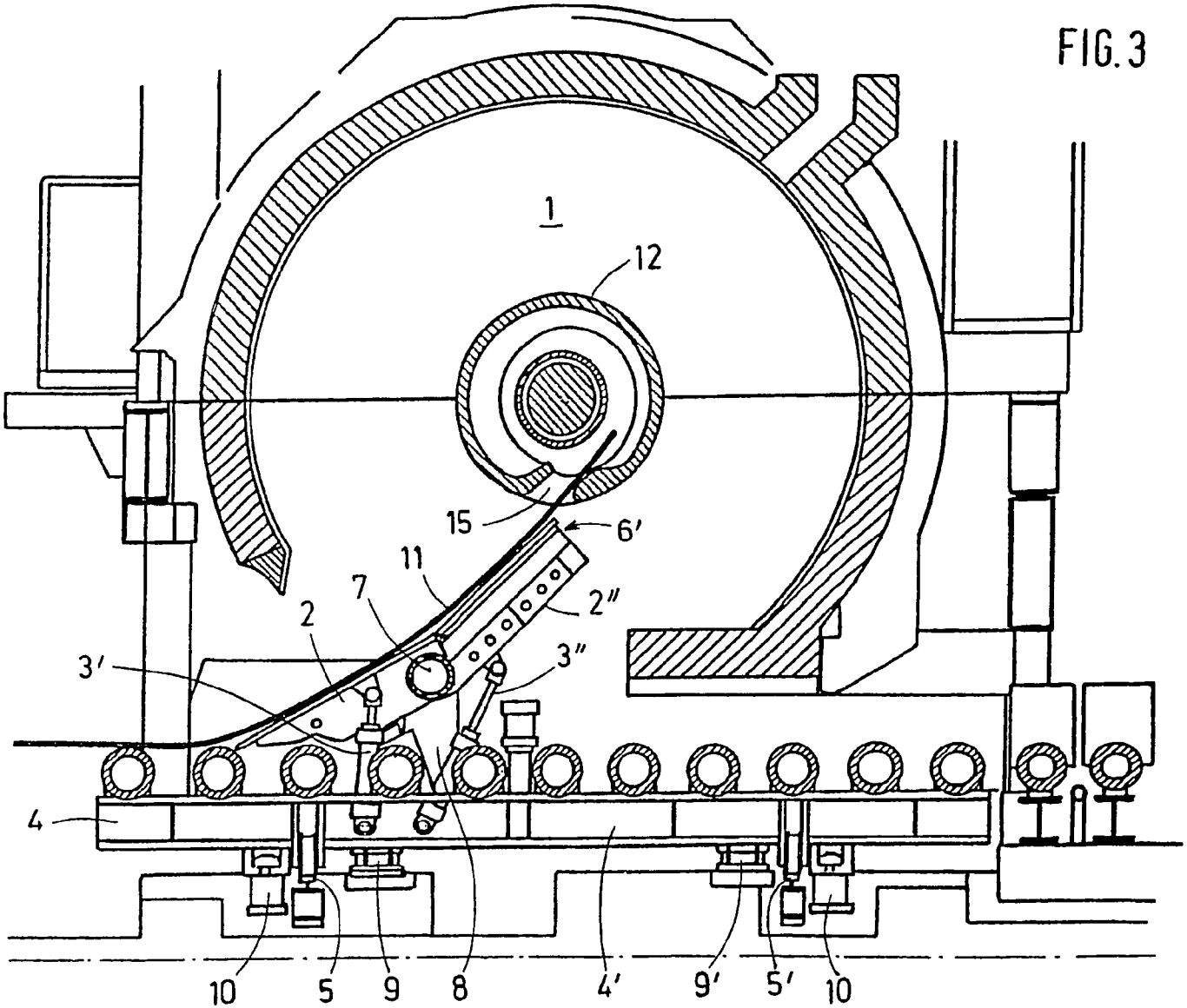
FIG. 3 shows the coiler furnace according to FIG. 1, but with the door completely open and oriented at an angle to allow a rolled strip to be fed in and coiled up.

For the feed-in phase, as FIG. 3 shows, the hydraulic cylinders raise the rear door elements 2', 2" so that the arriving rolled strip 11 is lifted to such a level that it can engage in the feed slot 15 in the furnace drum 12, where it is gripped and carried along by the drum when the drum starts to turn.

The inventive design of the coiler furnace doors, which are attached to the movable roller table, is uncomplicated and extremely effective and greatly improves the ability to maintain coiler furnaces.

LIST OF REFERENCE NUMBERS

1 coiler furnace
2 furnace door
3 hydraulic cylinder for pivoting
4 roller table frame/roller table frame part
5 guide rails
6 guide tables
7 door support
8 bracket
9 support pad
10 locking cylinder
11 rolled strip
12 furnace drum
13 reel support
14 traveling rollers
15 feed slot

The invention claimed is:

1. Furnace doors (2) for coiler furnaces (1) suitable especially for Steckel rolling mills, where, as the hot-rolled strip is being transported back and forth in a reversing manner through the mill, it is coiled onto a drum in one of these furnaces and uncoiled from another drum in the other furnace and possibly heated, the door being equipped with guide tables (6, 6'), which are mounted on the movable furnace doors to feed in and guide the strip, where the furnace doors (2) and the coiler furnaces (1) are separate components, each furnace door (2) being divided into at least two elements (2', 2"), which can be folded toward and away from each other, and where the two door elements are connected by a door support (7) so that they have the freedom to pivot, wherein the furnace door (2) is mounted on a part (4') of a roller table frame (4) underneath the coiler furnace (1), and in that the roller table frame (4) can be moved along with the furnace door (2) along guide rails (5) and out of the thermal radiation zone of the coiler furnace (1).

2. Furnace door according to claim 1, wherein the door support (7) is mounted on the roller table frame (4) by brackets (8), one on the drive side, the other on the operating side.

3. Furnace door according to claim 1, wherein the roller table frame (4) can be moved by means of one or more hydraulic cylinders.

4. Furnace door according to claim 1, wherein adjustable support pads (9) for holding the roller table frame (4) in the exact position required are mounted underneath the coiler furnace (1).

5. Furnace door according to claim 1, wherein locking cylinders (10) are provided to lock the roller table frame (4) in the exact position required underneath the coiler furnace (1).

6. Furnace door according to claim 1, wherein at least one hydraulic cylinder, preferably mounted on the operating side, is assigned to each of the pivoting door elements (2', 2") of the furnace door (2).

7. Furnace door according to claim 1, wherein the furnace door (2) is mounted on the brackets (8) in such a way that its height can be adjusted.

* * * * *